United States Patent [19]

Jones

[11] Patent Number: 4,633,205

[45] Date of Patent: Dec. 30, 1986

[54] LOOP COUPLED YIG RESONATOR

[75] Inventor: Keith E. Jones, Aloha, Oreg.

[73] Assignee: Tektronix, Inc., Beaverton, Oreg.

[21] Appl. No.: 801,280

[22] Filed: Nov. 25, 1985

[51] Int. Cl.[4] ..... H01P 7/06

[52] U.S. Cl. ..... 333/219; 333/33; 333/223; 333/231

[58] Field of Search ..... 333/33, 35, 219, 220, 333/222, 227, 235, 246, 202, 248, 230–231, 223; 331/96, 107 DP

[56] References Cited

U.S. PATENT DOCUMENTS 3,576,503 4/1971 Hanson ..... 331/96

4,500,858 2/1985 Mezak ..... 333/219 X

*Primary Examiner*—Marvin L. Nussbaum

*Attorney, Agent, or Firm*—Francis I. Gray

[57] ABSTRACT

An improved loop coupled YIG resonator has a coupling loop of three sections, a loop section partially encircling a YIG resonator, and two straight end sections. The end sections together with a ground plane enclosing one end of the resonator cavity form a transmission line, the characteristic impedance of which is determined by the distance of the end section above the ground plane. The characteristic impedance is chosen to match the transmission line input to which the coupling loop is connected.

7 Claims, 8 Drawing Figures

LOOP COUPLED YIG RESONATOR

BACKGROUND OF THE INVENTION

The present invention relates to loop coupled YIG resonators, and more particularly to an improved loop coupled YIG resonator which reduces parasitic series inductance to increase the usable frequency range.

A typical YIG resonator 10 is shown in FIGS. 1 and 3. A metallic housing 12, split into two halves 12*a* and 12*b*, has a thinned central section 14. In the central section 14 are located one or more resonator cavities 16, each having a YIG resonator 18 located centrally therein. At each end of the housing 12 is a connector 20 having a conducting lead 22 lying in a groove milled in the two halves 12*a*, 12*b* of the housing. The conducting lead 22 tapers down to a fine wire 24 near the cavities 16. A coupling loop 26 is located in the cavity 16 with a one-half turn around the YIG resonator 18. The ends of the coupling loop 26 are integrally attached to the fine wires 24 on one end and are grounded at the other end 27. A pair of electromagnets 28, having a central pole piece 30 and a surrounding electrical winding 32, are located contiguous to the housing 12 so the tips of the pole pieces contact the central portion 14 of the housing 12 to provide the necessary magnetic field for the YIG resonators 18. The two spheres 18 are coupled together by an interstage pair of loops 25 as shown in FIG. 2.

For the configuration as shown in FIG. 3 the equivalent circuit at very high frequencies is shown in FIG. 4. The resonator 18 is represented by an LC tank circuit and the actual loop portion of the coupling loop 26 is represented by an inductor which acts as the primary of a transformer to couple energy to the inductive component, i.e., secondary, of the LC tank circuit. The ends of the coupling loop 26 which extend from the actual loop to the walls of the cavity 16 are represented by additional series inductive elements. Due to the effect of the parasitic series inductive elements the coupling efficiency between the coupling loop 26 and the YIG resonator 18 decreases at higher frequencies. This decreased coupling efficiency becomes significant at 18 GHz and above as shown in FIG. 5 by the solid line. The series inductance could be reduced by moving the cavity walls closer together, but this results in a decreased Q of the resonator.

Therefore what is desired is a means for minimizing the parasitic series inductance without affecting the Q of the resonator.

SUMMARY OF THE INVENTION

Accordingly, the present invention provides an improved loop coupling YIG resonator which has a coupling loop with an impedance matched transmission line characteristic within the resonator cavity. The YIG resonator and coupling loop are offset to one end of the cavity. A ground plane is provided across that end of the cavity so that the end portions of the coupling loop form a transmission line with the ground plane and have the same characteristic impedance as the transmission line entering the cavity.

Objects, advantages and novel features of the present invention will be apparent from the following detailed description when read in conjunction with the appended claims and attached drawing.

DESCRIPTION OF THE PREFERRED EMBODIMENT

Figure 1:
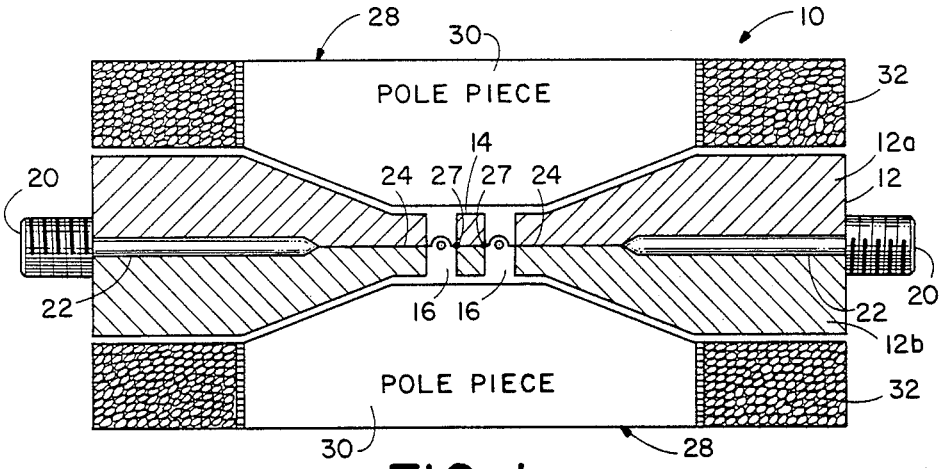
FIG. 1 is a cross-sectional view of a typical YIG resonator.
Figure 3:
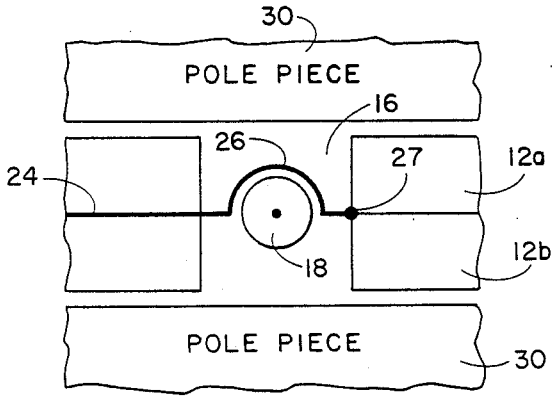
FIG. 3 (PRIOR ART)
FIG. 3 is an exploded view of one of the prior art resonator cavities incorporated in the resonator of FIG. 1.
Figure 6:
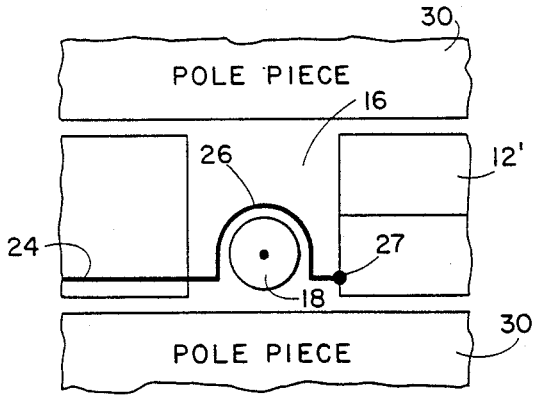
FIG. 6 is an exploded view of one of the resonator cavities of FIG. 1 according to the present invention.
Figure 2:
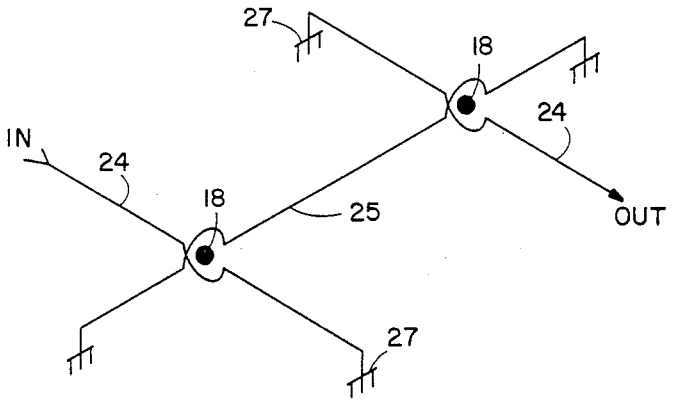
FIG. 2 is a schematic representation of the coupling between the YIG spheres of FIG. 1.

Referring now to FIG. 6 an improved loop coupling YIG resonator is shown. The fine wire 24 is displaced toward one end of the cavity 16 prior to entering the cavity. The coupling loop 26 has its ends parallel to and near the surface of the pole piece 30 which acts as a ground plane. Thus, the ends of the coupling loop 26 and the pole piece 30 form a transmission line having a characteristic impedance which is a function of the distance of the end portions of the loop from the ground plane, as is well-known in the art. This distance is adjusted so that the characteristic impedance matches the transmission line impedance input to the cavity formed by the fine wire 24. Such impedance is typically 50 ohms.

Figure 7:
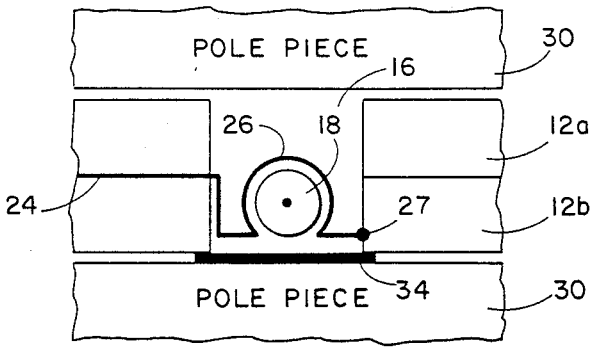
FIG. 7 is an exploded view of one of the resonator cavities of FIG. 1 showing an alternate embodiment of the present invention.

In lieu of having the fine wire 24 being offset, the wire can remain centered. However, as shown in FIG. 7 the integral coupling loop 26 at the entrance into the cavity is parallel to the surface of the cavity wall where it forms an impedance matched transmission line with the wall as a ground plane. Then the coupling loop is formed with the straight ends parallel to a ground plane 34. In this embodiment a conducting sheet is shown over the end of the cavity 16 to form the ground plane 34 in lieu of the pole piece 30.

Figure 8:
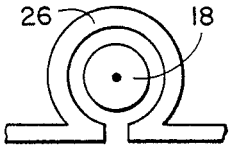
FIG. 8 is an expanded view of yet another embodiment of a coupling loop and YIG resonator.
Figure 4:
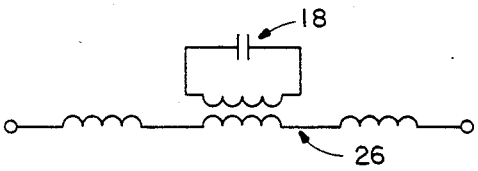
FIG. 4 is an equivalent circuit for the coupling loop and YIG resonator of FIG. 2.
Figure 5:
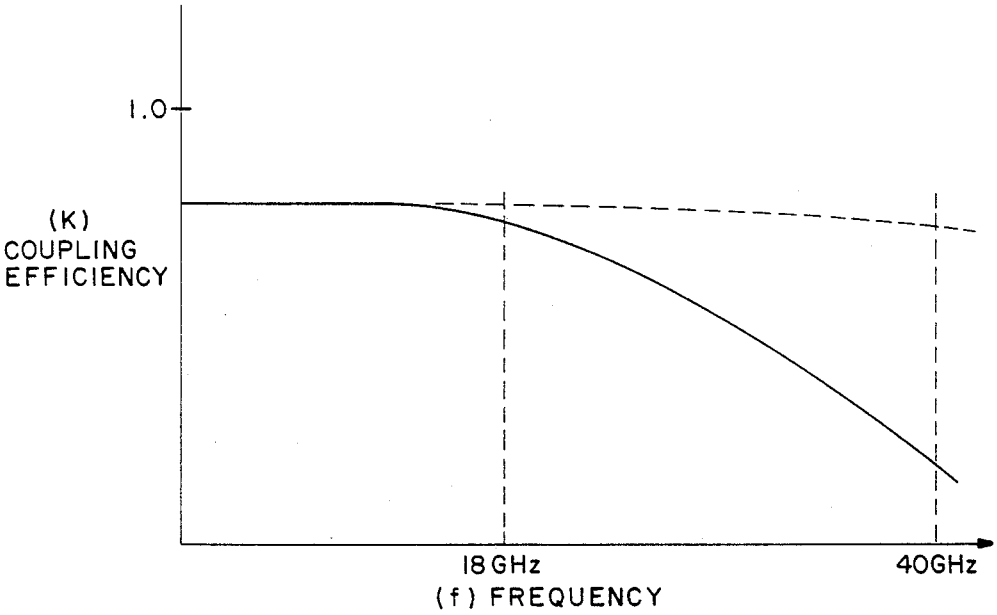
FIG. 5 is a graph of the coupling efficiency of a coupling loop and a YIG resonator as a function of frequency.

The conductor which forms the coupling loop 26 may be a chemically milled beryllium-copper conductor having a 2 mil square cross-section. As shown in FIG. 8 the coupling loop 26 may further be in the form of an almost complete loop instead of a one-half loop to increase the coupling between the coupling loop 26 and the YIG resonator 18.

Thus, the present invention provides an improved loop coupled YIG resonator which minimizes the parasitic series inductance of the coupling loop within the resonant cavity without reducing the Q of the resonator by forming an impedance matching transmission line within the cavity up to the actual loop.

What is claimed is:

1. An improved loop coupled YIG resonator of the type having a YIG resonator situated within a cavity of a housing, a coupling loop passing through the cavity partially encircling the YIG resonator, the coupling loop being grounded at one end and connected at the other end to a transmission line within the housing, and an electromagnet having a pole piece adjacent the cavity, wherein the improvement comprises the coupling loop being formed of three sections, a loop section partially encircling the YIG resonator, and two end sections, each end section forming an impedance matching transmission line with the transmission line within the housing to minimize the parasitic series inductance of the end sections at high frequencies.

2. An improved loop coupled YIG resonator as recited in claim 1 wherein the loop section substantially encircles the YIG resonator to improve the energy coupling between the coupling loop and the YIG resonator.

3. An improved loop coupled YIG resonator as recited in claim 1 wherein the impedance matching line comprises:

a ground plane on a side of the housing extending along a portion of the cavity adjacent the end sections of the coupling loop; and the end sections of the coupling loop situated parallel to the ground plane at a distance from the ground plane determined by the desired matching impedance.

4. An improved loop coupled YIG resonator as recited in claim 3 wherein the ground plane comprises the tip of the pole piece adjacent to and the cavity.

5. An improved loop coupled YIG resonator as recited in claim 3 wherein the ground plane comprises a conducting sheet of material attached to the housing and extending along the portion of the cavity.

6. An improved loop coupled YIG resonator as recited in claim 3 wherein the transmission line within the housing contigious to the cavity is at the same distance from the side of the housing on which the ground plane is situated as the end sections of the coupling loop.

7. An improved loop coupled YIG resonator as recited in claim 3 wherein the transmission line within the housing contiguous the cavity is at the midpoint of the cavity, and the coupling loop includes a section parallel to the wall of the cavity connecting the transmission line to the end sections of the coupling loop, the wall acting as the ground plane for the parallel section.

* * * * *